United States Patent [19]

Victorovich et al.

[11] Patent Number: 4,857,104

[45] Date of Patent: Aug. 15, 1989

[54] PROCESS FOR REDUCTION SMELTING OF MATERIALS CONTAINING BASE METALS

[75] Inventors: Grigori S. Victorovich, Toronto; Charles E. O'Neill, Mississauga, both of Canada

[73] Assignee: Inco Limited, Toronto, Canada

[21] Appl. No.: 165,911

[22] Filed: Mar. 9, 1988

[51] Int. Cl.[4] ..... C22B 1/02; C22B 23/00

[52] U.S. Cl. ..... 75/21; 75/26; 75/82

[58] Field of Search ..... 75/21, 26, 82, 24, 10.17

[56] References Cited

U.S. PATENT DOCUMENTS

| | | | |
|---|---|---|---|
| 4,087,274 | 5/1978 | Edenwall et al. | 75/10 R |
| 4,388,110 | 6/1983 | Jensfelt et al. | 75/21 |
| 4,514,217 | 4/1985 | Petersson | 75/10 R |
| 4,519,836 | 5/1985 | Sychev et al. | 75/25 |
| 4,740,240 | 4/1988 | Sulzbacher et al. | 75/26 |

*Primary Examiner*—S. Kastler

*Attorney, Agent, or Firm*—Francis J. Mulligan, Jr.

[57] ABSTRACT

A process for reduction smelting of copper-, nickel- or cobalt-containing materials in which such a material, at least partly in oxidic form is heated or combusted in finely divided form in a neutral or oxidizing flame to provide superheated particles. The superheated particles are then distributed onto a thin layer of coke. The materials in the particles are reduced in the thin layer of coke to metals or mattes or, in the case of iron, to wustite which forms a discardable slag with flux. Reduced product and slag form separate molten layers underneath the thin coke layer. All heat necessary for reduction and melting of product and slag is provided directly by the flame both in sensible heat in the superheated particles and by radiation.

17 Claims, 2 Drawing Sheets

PROCESS FOR REDUCTION SMELTING OF MATERIALS CONTAINING BASE METALS

The present invention relates to the field of extractive metallurgy of copper, nickel and cobalt. More particularly, it relates to a method of reduction smelting of various raw and intermediate materials containing these metals.

BACKGROUND OF THE ART AND PROBLEM

In general, raw and intermediate materials containing base metals can be divided into two main categories. One category represents a wide variety of raw and intermediate materials which contain non-ferrous base metals and substantial quantities of iron. The principal objective of reduction smelting of such materials is to separate non-ferrous base metals into a highly concentrated liquid phase containing these metals in the metallic and/or sulfidic form, and reject most of the iron in the form of a discard slag containing as low concentrations of non-ferrous metals as expedient economically.

This kind of metallurgical technology is currently applied in processing nickel laterite ores, partially roasted sulfide nickel concentrates, dead roasted copper concentrates (calcines), and various polymetallic raw or intermediate materials including dusts. With the exception of very few obsolete installations, this technology is at present carried out mainly in electric furnaces under reducing conditions.

Even though reduction electrosmelting proved to be quite effective in terms of separating non-ferrous metals from iron, this process involves large capital expenditures and operational costs. Moreover, in most cases it requires a very careful and expensive preparation of the feed. For example, nickel laterite ores must be well prereduced and preheated; nickel sulfide concentrates must be partially and precisely desulfurized as well as agglomerated; copper calcines must contain as low sulfur contents as possible, and so on. Furthermore, a non-ferrous metals producer who opts to use reduction electrosmelting process faces a choice of purchasing electric power or building its own power station. In the first case, the producer becomes economically dependent on the supplier of power, while in the second case even greater capital expenditures are involved. One more shortcoming of reduction electrosmelting technology stems from the fact that the best heat performance of electric furnaces is achieved when the feed is a dense, low porosity material, for example, in the form of briquettes or pellets, whereas materials to be fed into electro furnaces are most often finely divided. When a finely divided material is reduction smelted in electric furnaces, a number of undesirable phenomena occur including poor heat transfer to the feed, unnecessarily high degree of slag superheat and heat flux to the furnace refractory walls, premature and useless burning of solid reductant added to the feed, evolution of sulfur-containing gases, etc. Finally, electric smelting, as opposed to, for instance, flash smelting, has limited capability to utilize the energy from oxidation of sulfidic sulfur contained in concentrates of non-ferrous metals, and, therefore, is not an energy efficient process. In addition reduction electrosmelting is an inflexible process which is very sensitive to variations of feed and slag composition, especially with respect to iron and silica.

The other category of materials containing non-ferrous base metals represents a wide variety of intermediate products which do not contain substantial quantities of iron, if any. The principal objective of reduction smelting in this case consists in producing a melt which is practically oxygen free and is suitable either as a final product or as a semiproduct for further processing, for instance, for refining or alloying with other metals, whatever the case may be. Among numerous materials of this category, the following can be cited: nickel oxide, cobalt oxide, copper oxide, copper sulfide or nickel sulfide or a mixture of NiCu metallics with these sulfides (e.g., concentrates from separation of slowly cooled and then ground nickel-copper converter matte), various hydrometallurgical precipitates including partially oxidized copper cement, hydroxides and/or carbonates of nickel and cobalt, and many others. These materials in most cases are also quite finely divided. Although they can be processed in a number of ways, most often they too are reduced and smelted in electric furnaces, unless an old technology is used, i.e., reverberatory smelting or smelting in converters, for example. A roasting operation to eliminate sulfur is sometimes required prior to reduction smelting.

Thus, it is evident that reduction smelting of finely divided materials has a wide application in metallurgy of non-ferrous base metals. It is, in most cases, carried out in electric furnaces, and this process is characterized by a number of serious shortcomings already mentioned above.

The major incentives in developing new processes for reduction smelting of materials containing non-ferrous base metals are concerned with reducing capital expenditure and operational cost as well as with providing for operational flexibility of processing a wide variety of materials without having to undertake any major engineering and operational changes. A new process should be an energy efficient and pollution free one. As well, it should be able to take full advantage of the fact that most of the materials to be dealt with are already finely divided or, when necessary, can easily be ground.

DIRECTLY RELATED PRIOR ART

A number of new reduction smelting processes have been developed in recent years for the production of iron from oxidic ores or concentrates. The most promising five of them have been examined in a paper by J. J. Moore, "An Examination of the New Direct Smelting Processes for Iron and Steelmaking", published in Journal of Metals, June 1982, pp. 39–48. Each of these is a continuous two-stage process of (1) preheating and partial prereduction, followed by (2) final reduction and melting, the resulting product is high-carbon molten iron.

Out of these five processes, the INRED process is of particular interest as it has some features in common with the present invention and is claimed to be adaptable for processing oxidic materials containing non-ferrous metals as well. This process was earlier described in detail in the paper by H. I. Elvander, I. A. Edenwall and S.C.-J. Hellestam, "Boliden Inred Process for Smelting Reduction of Fine-grained Iron Oxides and Concentrates", published in Ironmaking and Steelmaking, 1979, volume 6, No. 5 pp. 235–244, and later in the paper by H. I. Elvander, "The Inred Process - A revolutionary Method to Produce Hot Metal", published in Iron and Steel Engineer, April 1982, pp. 57–80.

In this process, a flash smelting furnace and an electric smelting furnace are combined into one reactor, with the flash smelting furnace installed above the electric furnace. In the first stage of the process, a finely divided iron oxide is mixed with coal powder and fluxes and the mixture thereof is injected into the flash smelting furnace in a stream of gaseous oxygen. The coal is partly burned and partly carbonized to coke, while the oxide is melted and prereduced to wustite (FeO).

In the second stage of the process, the prereduced hot material, including the coke that has been formed, is collected in the electric furnace. Molten FeO and particles of the coke fall onto the surface of the charge previously accumulated in the electric furnace and form therein a large amount of semimolten, highly viscous pasty mass. Due to the endothermic reaction of reduction of wustite into metallic iron the mass cools rapidly to 1450° C. The upper level of the charge in the electric furnace consists of sponge iron, coke, unreduced molten material and burnt lime. Final reduction of FeO and melting of the sponge iron is effected at a lower level around the electrodes. Hot metal is collected underneath the slag bath which contains a partly submerged bed or coke.

The waste gas resulting from the partial combustion of coal in the flash smelting zone and the carbon monoxide rising from the electric furnace are burned with secondary and tertiary oxygen in the upper part of the flash smelting chamber. As a result, the temperature of the gases leaving the flash smelting chamber is about 1900° C. The heat of these gases is utilized to produce dry steam which, in turn, is employed to generate electrical energy required for the electric furnace and the oxygen plant. Efficiency of converting the heat from the steam into electrical energy is about 35%.

The overall consumptions of coal and oxygen while processing a 65% Fe hematite concentrate are about 40% and 60% by weight of the concentrate, respectively. At these values, the process can be energy self-sufficient.

Two important features of the INRED process have to be cited: (a) coal powder is the only substance that is used both as a fuel and a reductant, and (b) the conditions in the concentrate-coal-oxygen jets are such that excess of solid carbon is always present. Only a part of the feed coal is combusted. Accordingly the aeration ratio in the jets is below 50% and therefore the jet combustion gases must consist almost exclusively of carbon monoxide. Under these circumstances, combustion is very inefficient and the jet flame temperature is much lower than what it could have been had the aeration ratio been reasonably close to a 100%.

Two modifications of the INRED process were proposed as methods for processing finely divided sulfidic materials containing pyrite, pyrrhotite, chalcopyrite, galena, pentlandite, etc., as described in U.S. Pat. Nos. 4,087,274 and 4,388,110.

According to U.S. Pat. No. 4,087,274, the process consists of three consecutive stages which are carried out in three consecutively connected reaction zones positioned vertically one above the other. In the first zone, which is the uppermost part of the reactor, a metal sulfide containing material is subjected to combustion (oxidation) with oxygen, and the hot metal-oxide-containing material produced thereby falls downwardly into the second zone.

In the second zone, a finely divided solid carbonaceous reduction agent is introduced in a stream of oxygen-containing gas and combusted at an aeration ratio sufficiently low so as to effect only partial combustion of the reduction agent while converting a part of it into coke. The metal-oxide-containing material is partially reduced therein while falling downwardly through this zone, and along with the coked reduction agent enters the third zone where a substantially solid product (sinter) comprising partially reduced material and solid carbon is formed.

The third zone is essentially the same electric furnace as in the INRED process described above. In this zone, final reduction and melting of the sinter takes place.

It is evident that oxidizing conditions are obtained in the uppermost portion of the reactor while strongly reducing conditions prevail in the two lower zones. Any reducing gas formed in these two zones is combusted by supplying oxygen at the upper levels of the reactor, just below and in the first zone. This modification does not provide for the selective recovery of non-ferrous metals and can be used only for processing iron sulfide concentrates. In addition, there exists an enormous excess of heat in the first zone as, in addition to combusting sulfide minerals, the reducing gases from zones 2 and 3 are combusted there as well.

Another modification of the INRED process, according to U.S. Pat. No. 4,388,110, represents a principal departure from the concept described in the aforementioned papers and U.S. Pat. No. 4,087,274, since a carbon containing fuel and/or reductant is no longer added to the INRED reactor, no prereduction of metal oxides and formation of the coke containing sinter takes place, and only very limited quantities, if any, of molten non-ferrous metals are produced in the reactor. This modification simply consists in autogenous flame (flash) smelting of sulphidic materials in the presence of an oxygen surplus and silica flux to form a silicate melt which is poor in sulfur, followed by separating from the silicate phase any non-ferrous metal phase, if such is formed in the reactor, and by finally recovering non-iron metals present in the silicate phase by selective reduction thereof in one or more stages in at least one further furnace. Thus, at least one more separate furnace, in addition to the INRED reactor, is required to carry out the selective reduction of the molten silicate phase. It is evident that this modification is simply not a process for reduction smelting but for production of silicate slag containing non-ferrous metals, which slag then has to be reduced in a manner known per se in order to selectively recover these metals.

For a long time metallurgists were intrigued with the attractiveness of developing a one stage process for directly producing a molten metal from finely divided oxides in a reducing flame resulting from partial (incomplete) combustion of a fuel. Examples of such interesting ideas can be found in U.S. Pat. Nos. 774,930, 817,414, 1,847,527, 4,421,552, Canadian Pat. No. 864,451 and USSR Author certificates 86983 and 199,397. In particular, U.S. Pat. No. 4,421,552 contemplates a process whereby copper metal is produced from a dead roasted copper-iron sulfide concentrate (calcine) by reduction flash (flame) smelting of the dead roasted calcine using pulverized coke, coal or other reductants (fuel). The calcine is charged into a reduction flash smelting zone with oxygen and reductant through the same burners, the amounts of oxygen and reductant being sufficient to effect reduction and melting of the copper content of the calcine and to produce a molten iron silicate slag. The slag is to be subjected to further processing prior to discarding as it has a copper content of about 5%, and a slow cooling-milling-flotation slag cleaning technology is contemplated to obtain a discard slag.

Unfortunately, none of these one stage flame (flash) reduction smelting methods has made its way to industrial application either for production of iron or non-ferrous metals. The principal difficulties involved in these one stage processes involve the following considerations. A high degree of reduction of finely divided oxides of non-ferrous metals in a flame is extremely difficult to attain even with combustion gases having a very high reduction potential. On the other hand, an increase in the reduction potential of combustion gases in the flame requires that the fuel aeration ratio be decreased so that only a very low degree of combustion of the fuel is achieved. But the more incomplete the combustion is, the less efficient it is in terms of utilization of the fuel calorific power and the lower is the theoretical flame temperature. This interrelation is illustrated quantitatively in FIG. 1 of the drawing using methane and oxygen as an example. In FIG. 1 the fuel aeration ratio is the actual amount of oxygen supplied per a given quantity of methane divided by the theoretical amount of oxygen required to effect complete combustion of this methane times 100; the net heat available at 1600° C. represented in FIG. 1 by curve B is the amount of heat in kcal per g.mole $CH_4$ that is available as a result of combustion at this temperature; the reduction potential of combustion gases represented in FIG. 1 by curve A is a volume concentration ratio of $H_2+CO$ to $H_2O+CO_2$; and the theoretical flame temperature represented in FIG. 1 by curve C is the temperature that is developed as a result of combustion of methane with oxygen. All data in FIG. 1 are given for absolute pressure of 1 atmosphere and initial temperature of methane and oxygen of 20° C. In general, the interrelation in FIG. 1 also holds for fuels other than methane, for example, for oil or coal.

FIG. 1 shows that any attempt to enhance the reduction of finely divided metal oxides in the flame by strengthening the reduction potential of combustion gases, that is, by decreasing the fuel aeration ratio, is inevitably associated with a dramatic decrease in the efficiency of direct utilization of the fuel calorific power. For example, combustion of methane at the aeration ratio of 50% results in only about 20% of the net heat that can be available at an aeration ratio close to a 100%. Moreover, the theoretical flame temperature at the 50% aeration ratio is about 2275° C. which is about 500° in Celsius units lower than the theoretical flame temperature provided by an aeration ratio close to 100%. This lower theoretical flame temperature results in a decrease by a factor of 2.2, of heat transferred by radiation from the flame.

Thus, enormous uneconomic quantities of fuel, as well as oxygen would be required for the process contemplated in U.S. Pat. No. 4,421,552 or for any other process in which the reduction of finely divided non-ferrous metal oxides would be attempted in a reducing flame resulting from incomplete combustion of a fuel. Of course, the exhaust gases still containing substantial concentrations of $H_2$ and/or CO can be afterburned and the heat generated thereby can be partially recovered, for example, in the form of electric power, as is done in the case of the INRED process. However, this route of improvement in the overall utilization of the fuel calorific capacity may be economically unwarranted for a producer of non-ferrous metals because it requires substantial capital expenditure and operational cost. In addition to having to handle much greater volumes of the exhaust gases and gases from after burning the latter, the process produces much greater quantities of dust caused by these large volumes of gases. It is very expensive to produce electrical energy by combusting a fuel with oxygen at a very low aeration ratio and then recuperate the chemical heat contained in the exhaust gases by afterburning, even though this electrical energy can be utilized for producing the oxygen. Such recuperation of energy is not only thermodynamically inefficient but also capital intensive.

A producer of non-ferrous metals would greatly benefit from a new reduction smelting process which would require minimal capital expenditure and use minimal quantities of fuel and oxygen; a process which would generate minimal quantities of exhaust gases and dust; a process which would be flexible in terms of its adaptability for processing a variety of finely divided materials and for utilizing any fuel that is available at the lowest price; a process which would be carried out in a single reactor of simple design and as low cost as possible; a process which would produce a directly discardable slag without having to use any slag cleaning operation at all; and a process which is easy to control and operate.

SUMMARY OF THE INVENTION

The present invention contemplates a process for reduction smelting of finely divided material containing at least one base metal from the group consisting of copper, nickel and cobalt at least partly in oxidic form comprising the following steps:

(a) injecting such material along with fuel and oxygen and a finely divided flux, if any, into a bounded space while combusting said fuel to produce an essentially non-reducing, high temperature flame;

(b) superheating in said non-reducing flame particles of said finely divided material to a temperature significantly in excess of the highest melting point of reduced products to be produced;

(c) projecting said superheated particles essentially evenly onto a thin layer of granular coke floating on the surface of a molten bath of the said reduced products, said thin layer of granular coke and the adjacent atmosphere comprising a reduction zone;

(d) reducing oxides of said base metals in said reduction zone, with the reduced products being obtained in the liquid state, while supplying all required heat to the reduction zone solely in the form of sensible heat of the superheated particles and by radiation from the said non-reducing flame;

(e) percolating said reduced products through the coke layer to the said molten bath;

(f) withdrawing said reduced products from said molten bath, and;

(g) supplying a solid granular carbonaceous material to the said thin layer of granular coke to replenish the coke consumed in the reduction.

When fuel, e.g., hydrocarbon fuel, other than the sulfur or iron content of the finely divided material is used as the primary source of heat for the process, the fuel fed flame should have an aeration ratio close to 100%. When finely divided sulfidic material is also present in the flame it can supply part of the necessary heat but the flame in any event is non-reducing with respect to the oxide of the metal to be produced.

PARTICULAR DESCRIPTION OF THE INVENTION

Figure 1:
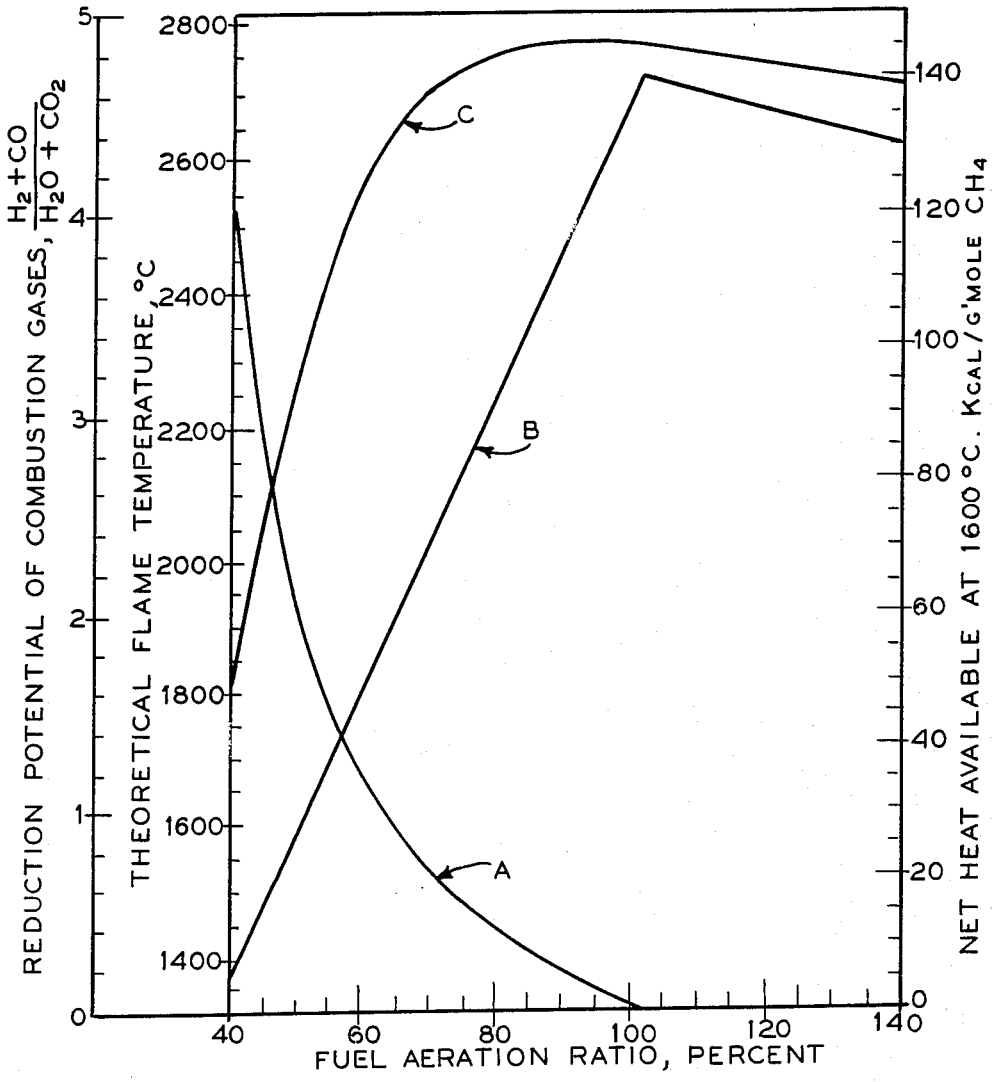
FIG. 1 is a graph showing the interrelations of fuel aeration ratio with (A) reduction potential of combustion gases (B) net heat available at 1600° C., and (C) theoretical flame temperature.

In greater particular, the process of the invention comprises:

(a) injecting through a burner at least one finely divided material containing at least one non-ferrous base metal, a fuel and/or at least one finely divided sulfidic material, which may also contain one or more non-ferrous base metals, a finely divided flux for slagging iron, if it is present in substantial quantities in the said materials, and gaseous oxygen into a preheated combustion zone, the weight proportion of oxygen relative to the fuel and/or the finely divided sulfidic material being reasonably close to what is required to effect the most efficient combustion of the said fuel and/or sulfidic material;

(b) combusting the fuel and/or the sulfidic material with oxygen to produce a substantially non-reducing high temperature flame and to superheat any condensed particles of the said materials in the flame to a temperature which is significantly higher than the highest melting point of reduced product produced in the process;

(c) spraying (or perhaps raining or projecting) the superheated condensed particles from the flame downwards into a reduction zone onto a thin layer of granular coke floating on the surface of a preexisting molten bath of the said reduced product, while combustion gases are separated from the superheated condensed particles and directed upwards;

(d) reducing oxides of non-ferrous base metals present in the said materials and/or produced in the flame into corresponding metals in the thin layer of granular coke in which layer a predominant proportion of iron oxides, if they are present in the said materials and/or produced in the flame, are reduced only selectively to the degree of reduction required to form a discardable molten iron-containing slag;

(e) percolating said reduced non-ferrous base metals and/or sulfides of base metals, including iron sulfide when it is required, and the iron containing slag, if it is present, through the coke layer to the said molten bath;

(f) withdrawing in continuous or intermittent manner, at least part of the final reduced molten product highly concentrated in at least one non-ferrous base metal and an iron-containing slag when iron is present in said materials; and (g) supplying a solid granular carbonaceous material having particle size at least 10 times greater than that of the said finely divided materials, in order to replenish the granular coke consumed in the reduction.

The following definitions are applicable to this specification and claims.

"Injecting" means that the solid finely divided materials, including flux, are introduced as a coherent jet into a preheated combustion zone as a suspension of fine solid particles as in a gas phase which includes gaseous oxygen and may also include gaseous fuel and any other gas that may be used to the advantage of the process;

a "Burner" means any burner or a device of similar purpose capable of feeding the above suspension as well as any combination of the above suspension with any other than gaseous fuel into a preheated combustion zone as a high velocity coherent jet, with any of the above ingredients of the jet being mixed with each other in any manner. Mixing can occur when the ingredients enter the burner, in the burner itself, immediately after exiting from the burner or any combination thereof;

"Finely Divided Material Containing at Least One Non-Ferrous Base Metal" means a pulverized material or a blend of materials which contains one or more metals such as copper, nickel and cobalt and which may contain minor impurity amounts of titanium, zinc, arsenic, antimony, selenium, tellurium, lead, bismuth, tin etc. said metal or metals being in one or a combination of the following chemical forms: oxides, oxides plus sulfides, oxides plus metals, oxides plus metals and sulfides, metals plus sulfides. as well as sulfates, carbonates and hydroxides. This material may also contain iron, precious metals, any of associated metals, metalloids and non-metals in minor amounts and rock. When iron is present, it may be in the form of iron oxides and/or ferrites of non-ferrous base metals.

a "Fuel" means any flowable fuel such as natural or any other gas, oil or any other liquid hydrocarbon, solid finely pulverized carbonaceous material or any combination thereof.

In some specific cases, elemental sulfur may constitute a part of fuel as well;

a "Finely Divided Sulfidic Material" means any kind of sulfidic material including ore concentrates and various mattes which react with oxygen and in some cases may be used as a substitute for fuel;

a "Finely Divided Flux for Slagging Iron" means any siliceous and/or calcareous flux to produce either an iron silicate or iron calcareous slag;

the "Most Efficient Combustion" means that the calorific power of fuel and/or sulfidic material, when they are combusted with oxygen, is utilized to the extent reasonably close to the maximum. In the case of fuel this is achieved when the fuel aeration ratio (actual amount of oxygen supplied divided by the theoretical amount of oxygen required to effect complete combustion of all the combustibles times 100) is reasonably close to 100% e.g., about 90% to about 130%. In case of sulfidic materials this is achieved when sulfur is oxidized into sulfur dioxide and/or the combustion gases contain very little, if any, free oxygen, with the process heat balance requirements being fully satisfied by the oxidation of the sulfidic sulfur;

"Finely Divided" means having a state of subdivision such that individual particles of materials so described have an average cross-sectional dimension less than about 500 micrometers e.g., 100%-10mesh and 80%-200 mesh (U.S. Standard Sieve Series);

a "Thin Layer of Granular Coke" means a layer which is about 1–5 cm thick, with the maximum coke particle size being about 15–25 mm, and the minimum coke particle size fed to that layer is no less than about 5 mm.

"Selective Reduction of Iron Oxides to the Degree of Reduction Required to Form a Molten Discardable Iron-Containing Slag" means that ferric iron oxide, whether free or bonded into ferrites, is predominantly reduced to ferrous iron oxide, otherwise known as wustite, and the slag does not require any further treatment such as slag cleaning to recover non-ferrous metals, and, therefore, can directly be discarded.

"Discardable Iron-Containing Slag" means an iron-containing slag in which the contents of copper, nickel and/or cobalt are sufficiently low so that, as an economic proposition, the slag is discardable. The composition of the slag depends in part on the composition of initial feed materials and on the product phase in contact with the slag. The slag may require treatment for reasons other than the copper, nickel or cobalt content. For example, when treating copper-zinc-tin materials slag may very well have to be treated for the recovery of zinc and/or tin before it can be discarded.

"Solid Granular Carbonaceous Material" means any coking material with particle size in the range between about 5 and 25 mm.

The present invention is based on a number of findings obtained in the course of experimental work aimed at developing a simple, economical and flexible process for reduction smelting of a wide variety of materials containing non-ferrous base metals in oxidic and/or sulfidic as well as sometimes partially in metallic form. A most valuable and unexpected discovery was that finely divided and superheated particles containing non-ferrous metals in oxidic form, when being continuously sprayed or rained onto a thin layer of hot granular coke, were rapidly reduced into corresponding metals, the metals melted and percolated underneath the coke layer and the coke stayed afloat on the molten bath.

It has also been discovered that, when iron oxides in the form of hematite, magnetite and/or ferrites of non-ferrous base metals were present among and/or in the finely divided superheated particles, the rapid reduction of all oxidic forms of non-ferrous base metals in the coke layer proceeded as well and complete as in the absence of the oxidic forms of iron. Moreover, this reduction was surprisingly highly selective with the oxidic iron being predominantly reduced only to the form of wustite.

Furthermore, it was found that finely divided and superheated particles of a flux for slagging iron, when being continuously sprayed in appropriate quantities onto the layer of coke along with the superheated particles containing non-ferrous metals and iron oxides, reacted very rapidly with the wustite to form a molten iron silicate or iron calcareous slag. The formation of the slag in situ with the reduction in the thin layer of coke was discovered to give a very low content of non-ferrous metals in the slag and, therefore, to render the slag directly discardable. The slag percolated underneath the coke layer very rapidly and the separation of the non-ferrous metal phase and the slag was excellent as practically no prills of the non-ferrous metal phase were ever found mechanically entrained in the slag.

One more very surprising and valuable finding was that wustite, after being obtained by the selective reduction of iron oxides and then slagged with a siliceous flux and percolated underneath the coke layer in the form of a molten slag, was no longer amenable to further reduction by the coke floating on the surface of the slag. This was so even after the spraying had been discontinued. The exact mechanism of this unexpected phenomenon remains unknown at this time although some factors probably contributing into it can be cited. Among them are the facts that, as practiced, (a) the molten bath under the layer of coke remains largely stagnant, (b) there is only a small immersion of the coke into the slag as the coke layer is thin and, (c) temperature at the slag-coke interface is relatively low (as opposed to, for example, in the electrosmelting process). These and possibly other factors inhibit any further reduction of wustite from the slag thus providing for an excellent separation of iron from non-ferrous metals.

The above-noted findings as well as other novel features of the process will be illustrated hereinafter in examples of various embodiments of the present invention. Since this invention is concerned with processing a wide variety of materials containing base metals, its description will be given in conjunction with particular examples representing at least some of these materials. However, the essential principles of the process will be described first, using reduction of finely divided oxides of non-ferrous metals simply as a convenient illustration.

EMBODIMENTS OF THE INVENTION

In its most general and simple form, the process of the present invention consists of three main indivisible steps which take place continuously and simultaneously in the same furnace: (a) superheating finely divided particles of the oxides in substantially non-reducing high temperature flame, (b) spraying or raining these superheated particles onto a thin layer of granular coke floating on the surface of the molten bath of the metals, and (c) reduction of the oxides into the corresponding metals in a thin layer of granular coke.

Figure 2A:
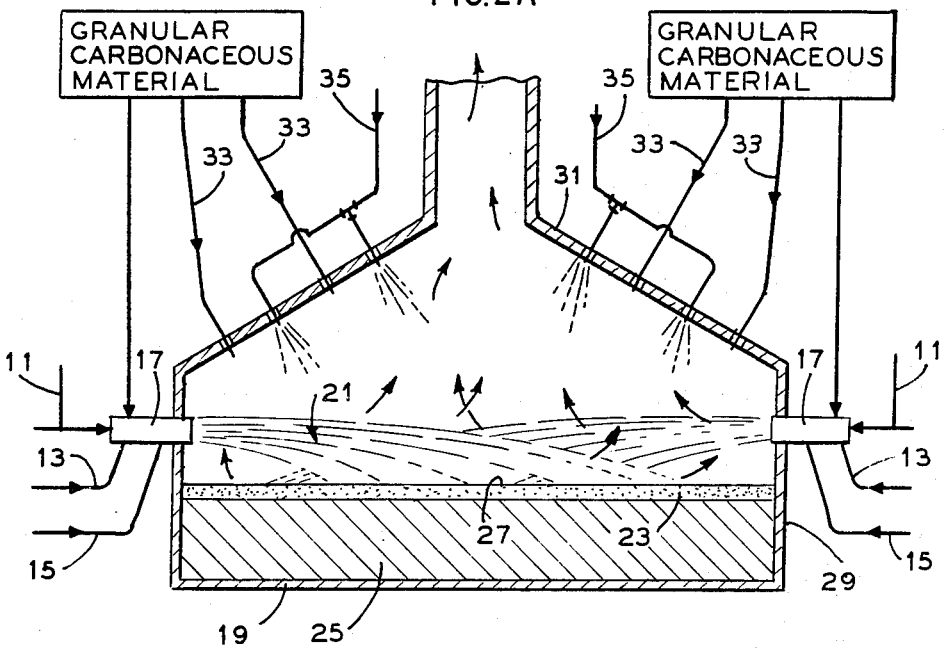
FIGS. 2A and 2B are schematic views of an idealized furnace suitable for carrying out the process of the present invention.

Step (a) is carried out in the following manner with reference to FIGS. 2A and 2B of the drawing. A feed of the oxides 11, fuel 13 and oxygen 15 is injected through a burner 17 into preheated furnace 19. The fuel aeration ratio in the feed jet is maintained reasonably close to a 100%. This, according to FIG. 1, provides for the most efficient combustion of the fuel. The reduction potential of combustion gases in the flame may be either zero when the aeration ratio is at or greater than 100%, or it may be a small value such as about 0.05–0.10 which corresponds to the aeration ratio of nearly 95%. In general, however, the reduction potential of combustion gases is not greater than or below that for the equilibrium coexistance of the metal with its oxide and the gas phase, for example, for the Ni-NiO-gas phase equilibrium. Thus, the flame is substantially non-reducing with respect to the metal oxide and may rather be oxidizing for the corresponding metal.

The amount of fuel in the feed jet is determined by the overall heat balance of the reduction smelting process because, when treating oxidic materials, the heat generated by combustion of the fuel is by far the most important source of energy that is required for the process. In general, the amount of fuel must be such that the oxide particles in the flame ca be heated to a temperature which is significantly higher than the melting point of the reduced molten metal. In the case of nickel oxide, for example, the amount of fuel must be sufficient to heat the nickel oxide particles in the flame to a temperature which is well above 1450° C., and temperatures of about 1600°–1800° C. will satisfy this condition. Such a temperature is easily attained since the theoretical flame temperature resulting, for example, from combustion of methane (natural gas) with oxygen at the aeration ratio close to a 100% (curve C in FIG. 1) is about 1000° C. higher.

According to step (b), the superheated oxide particles are sprayed or rained from the flame 21 onto a thin layer of granular coke 23 floating on the surface of the molten bath 25. The spraying is an essential feature of the present invention. It is desirable that the spraying covers as much of the surface 27 of thin layer of granular coke 23 as practical and the superheated particles are distributed over the surface as evenly as possible. On the other hand, it is recommended that the walls 29 of the furnace 19 be clean of spray. In this way a risk is avoided of either forming a build-up of a refractory material such as nickel oxide on the walls or dissolving the furnace wall refractories by a low melting point and corrosive material such as copper oxide.

Figure 2B:
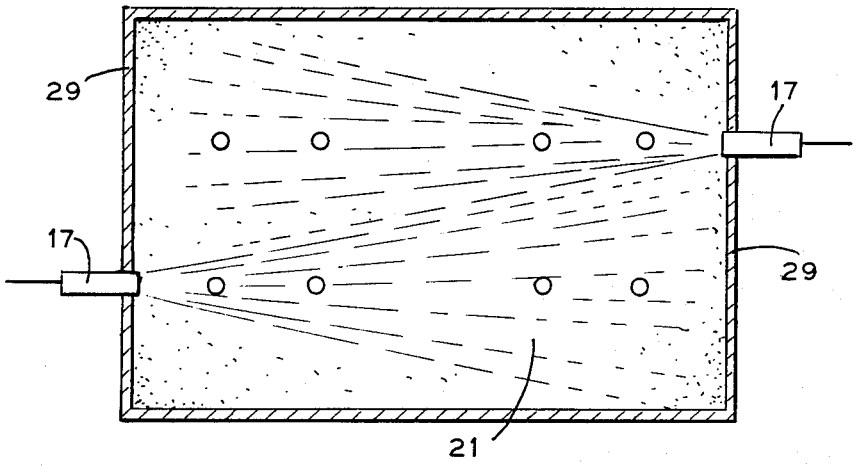

The simplified schematic of FIG. 2B shows an apparatus comprising two burners 17 positioned approximately horizontally and in such a way that the flames 21 from the burners do not interfere with each other. The superheated particles drop out of flames 21 onto the coke layer 23 due to the gravitational force while combustion gases are separated from the particles and directed upwardly.

There are numerous ways of providing for evenly spraying and distributing superheated particles onto and over the coke layer 23. Burners 17 can, for example, be rocked n a vertical plane and/or a horizontal plane, or they may make any other kind of movements of predetermined trajectory which will be to the benefit of the process. Furthermore, they may be installed in the furnace roof 31 rather than in the end walls 29 or side walls 28, and may be stationary or mobile, moving along the walls 29 or the roof 31. Furnace 19 itself may be of any configuration, for instance, round, with burners 17 positioned to create a vortex similar to that used in the INRED process, or furnace 19 may rotate in the manner of a top blown rotary converter. Other configurations are possible. All these and other possible furnace and burner configurations are deemed to be within the ambit of the present invention provided that the process of the present invention is carried out therein.

Reduction of the oxides 11, step (c), takes place in a thin layer of granular coke 23 floating on the surface of the molten bath 25. The success of this step depends on providing for the balanced relationship of the rate of reduction, the rate of heat transfer to the coke layer and the rate of percolation of the reduced metals through the coke layer.

The rate of reduction depends on the nature of non-ferrous metals oxides 11 and the size of their particles being sprayed onto coke layer 23. For example, nickel oxide is more difficult to reduce than copper-oxide as nickel oxide and nickel metal have very high melting points (about 1960° C. and about 1450° C., respectively), molten nickel metal has a relatively low solubility of oxygen (and carbon), and the reduction potential for the Ni-NiO-gas phase equilibrium is noticeably higher than that or copper. In addition, the rate of percolation of molten nickel through the layer of coke is lower than that for copper metal because the surface tension of nickel is much higher that for copper (about 1900 dynes/cm at 1550° C. versus about 1300 dynes/cm at 1100° C., respectively).

Ideally, the above mentioned balanced relationship means that, at a given rate of reduction, the heat transfer and the rate of percolation must be sufficiently high so that the reduced metal is produced in a molten state and it percolates rapidly underneath the layer of coke 23. If this relationship is not balanced, the granular coke gets imbedded into a mixture of solid oxide and solid metal resulting in the formation of sinter which is characteristic of the INRED process, rather than of the process of the present invention. Since the sinter is a hindrance for the heat transfer, the formation of it upsets the present process: the sinter layer becomes progressively thicker, the molten bath freezes and, as a consequence, the entire process comes to a complete halt.

In the present process, the heat is transferred to the layer of coke 23 mainly by the superheated condensed particles being sprayed onto it and by the radiation from the flame and the furnace walls. In the above example with nickel oxide, if the layer of coke 23 is maintained at about 1500° C. and the nickel oxide particles are heated in the flame to a temperature of 1600° to 1800° C., the proportion of heat being transferred to the reduction zone with the superheated solid nickel oxide particles is about 60% to 70%. The rest of the heat required for the endothermic process of reduction of NiO and melting the reduced nickel metal as well as for heating gaseous products of the reduction comes to the layer of coke mainly via radiation. It is not desirable, according to the present invention, that the convection of combustion gases plays an important role in transferring heat to the reduction zone as this will result in excessive gasification of the coke layer 23 and will worsen the conditions of the reduction process. This is why the gases are separated from the zone. Conducting the process at the aeration ratio in the flame close to a 100% provides the best fuel efficiency at the highest theoretical flame temperature which, in turn, promotes the best possible heat transfer by radiation.

The rate of reduction of course will be enhanced by conducting the process at a higher temperature. On the other hand, the rate of reduction can also be enhanced when materials to be reduction smelted consist of particles which have a reasonably small size. The rate of reduction is the highest when the superheated condensed particles being sprayed onto the layer of coke 23 are molten as is the case, for example, with copper oxide (as opposed to nickel oxide). As well, the proportion of heat being transferred to the reduction zone with the superheated particles when they are molten increases up to about 80–95% depending on the flame temperature.

When the heat transfer is adequate, the rate of reduction and melting can become faster than the percolation rate. In this case, percolation can become a limiting factor of the entire process. It was found that the rate of percolation accelerates in the presence of surface active substances, with sulfur and oxygen among them. Very small concentrations of these substances dramatically decrease the surface tension of non-ferrous metals and alloys and, therefore, are conducive for enhancing the rate of percolation.

As a result of reduction of the non-ferrous metal oxides (step (c) above), some coke is consumed and a gas phase consisting of $CO_2$ and CO is evolved from the layer of coke. In order to replenish the granular coke consumed by the reduction reactions, a solid granular carbonaceous material is supplied to the reduction zone. This may be done in a variety of ways, and two possible options are illustrated in FIG. 2.

One of the options is to feed the carbonaceous material 33 through furnace roof 31 into the feed jets (flames 21). Another option is to introduce this material with the feed through burners 17. In both cases, the carbonaceous material 33 gets distributed quite evenly over layer of coke 23. Since this material, according to the present invention, has a particle size in the range of about 5 mm to about 25 mm, only a small proportion of it will burn while passing through flame 21 and falling onto the layer of coke 23. This amount of coke burning may be taken into account by adjusting the proportion of oxygen 15 and fuel 13 so that the aeration ratio in the flame remains at the level required by the process.

Carbon monoxide evolving from the layer of coke 23 may be afterburned in furnace 19. This can be done either by introducing secondary oxygen 35 and/or air, as depicted in FIG. 2, or by adjusting the fuel aeration ratio to above 100% as would be required to complete the afterburning of the carbon monoxide. The afterburning will contribute to the overall heat balance resulting in further decrease in consumption of fuel.

EXAMPLE I

A nickel copper alloy was prepared using a blend of industrially produced oxides of nickel and copper. The blend contained, in wt. %: 35.5 Ni, 39.3 Cu, 3.9 Fe and 0.5 Co. The particle size distribution in the blend was as follows:

| size, m | +212 | −212 + 150 | −150 + 75 | −75 + 38 | −38 |
|---|---|---|---|---|---|
| wt. % | 0 | 26 | 16 | 38 | 20 |

This blend was continuously injected with natural gas and oxygen through a water cooled burner into a furnace which was preheated to a desired temperature. During experiments the furnace operated autogeneously. To attain this, it was heated externally but only to the extent necessary to prevent (compensate) losses of heat from the furnace through its walls, bottom and roof. Thus, the furnace was essentially adiabatic and, therefore, the heat required for the reduction smelting process that was conducted in it, was generated entirely inside the furnace by combustion of the fuel-oxygen mixture with which the oxide blend was injected.

The feed jet was injected into the upper part of the furnace space which served as a combustion zone. The lower part of the furnace, below the combustion zone, contained a receiving crucible. Hot particles of the oxide feed fell from the feed jet (flame) downwards to be collected in the receiving whereas hot combustion (waste) gases were removed from the furnace space through an uptake in the furnace roof.

The production of nickel-copper alloy was conducted at a fuel aeration ratio of 95% which corresponds to a reduction potential of combustion gases of only about 0.07 (see FIG. 1 of the drawing). This reduction potential value is lower than that required for the reduction of nickel oxide at the temperatures which were used in this experiment (see below) and, therefore, no reduction of nickel oxide was thermodynamically possible in the flame. On the other hand, cupric copper oxide, which was about 49% by weight of the oxide blend, is thermodynamically unstable at a high temperature. It dissociates in air atmosphere at about 1020° C. as follows:

| | |
|---|---|
| 2 CuO | $Cu_2O + 0.5\ O_2$ |

The dissociation oxygen pressure at the flame temperatures of well above 1400° C. is of several orders of magnitude higher than 1 atmosphere. The oxygen resulting from the above dissociation reaction, which in a high temperature flame proceeds practically in no time, must be considered as directly participating in the combustion process, and, therefore, this oxygen was added to the gaseous oxygen when calculating and setting the above 95% aeration.

Accordingly, in this operation, natural gas and the gaseous oxygen inputs were set at about 7.0% and 20% by weight of solid feed, respectively, and the solid feed rate was 9.7 kg/h.

Before the run was started, a 4.6 kg nickel-copper alloy heel was premelted in the receiving crucible with about a 3 cm thick layer of coke breeze (reductant) on its surface. During the test the thickness of the coke layer was maintained at about 2–4 cm by adding coke through the furnace roof.

The solid feed included an addition of a sulfur containing material in the amount of 7.5% by weight of the oxide blend, in order to ensure a good rate of percolation of the metallic product through the coke. The composition of the sulfur containing material was, in wt. %:

| Cu | Ni | Co | Fe | S | $SO_4$ |
|---|---|---|---|---|---|
| 15.6 | 56.2 | 0.98 | 2.6 | 16.0 | 1.76 |

The coke breeze that was used in the run had the following composition, in wt. %:

| $C_{total}$ | $C_{fixed}$ | S | Volatiles | Ash | $H_2O$ |
|---|---|---|---|---|---|
| 89.3 | 89.2 | 0.47 | 2.42 | 8.11 | 0.28 |

Its particle size distribution was as follows:

| Size, mm | −13.5 + 4.75 | −4.75 + 2.36 | −2.36 + 1.7 | −1.7 |
|---|---|---|---|---|
| wt. % | 28.9 | 48.6 | 12.3 | 10.2 |

The coke ash contained, in wt. %:

| Fe | $SiO_2$ | $Al_2O_3$ | MgO | CaO |
|---|---|---|---|---|
| 7.4 | 54.5 | 25.6 | 5.1 | 1.9 |

This ash is highly refractory material which has to be fluxed in order to avoid its accumulation and attendant retardation of the metal percolation through the coke. This was achieved by forming an easy melting, low viscosity slag. Accordingly, a flux consisting, in wt. %: 75 CaO, 25 $CaF_2$, was added to the solid feed in the amount corresponding to 65% by weight of the ash $SiO_2+Al_2O_3+MgO+CaO$, or 4.6% by weight of coke consumed in the course of reduction. The resulting slag was expected to have the following composition, in wt. %: 34 CaO+MgO, 38 $SiO_2$, 18 $Al_2O_3$ and 10 $CaF_2$. This slag has a liquidus temperature below 1250° C and viscosity below 2 poises at 1400° C. The liquidus temperature and the viscosity of this slag decrease substantially as the slag iron content in the form of FeO increases.

The solid feed described above was fed into the furnace during 1.5 hours. The above mentioned rate of feeding of 9.7 kg/h corresponded to about 20 t/m$^2$ per day based on the coke bed cross sectional area inside the receiving crucible. During the test the waste gas temperature was 1470°-1480° C., the temperature above the receiving crucible was 1480°-1500° C. and the temperature on the inside of crucible bottom was about 1440° C.

After the run ended, pin samples of the liquid reduced metal were taken. The metal contained, in wt. %:

| Cu | Ni | Co | Fe | S | O | C |
|---|---|---|---|---|---|---|
| 46.9 | 49.0 | 0.078 | 2.67 | 0.67 | 0.03 | 0.02 |

Thus, it was demonstrated that a virtually complete reduction was achieved using the method of the present invention. In this test, the consumption of coke was about 9% by weight of the oxide feed. This consumption presents an excess of approximately 25% over the amount required stoichiometrically to reduce the oxides. The waste gases contained some concentrations of $H_2$ and CO, with the reduction potential being in the range of only 0.10-0.15.

EXAMPLE 2

This example illustrates that the process of the present invention can be successfully performed at a fuel aeration ratio slightly above 100%.

In this operation the solid feed was exactly of the same composition as in Example 1, but the fuel aeration ratio was 118%, that is, neither nickel nor copper metals could be produced in the flame itself as it contained free oxygen. Natural gas and the gaseous oxygen inputs were set at about 7% and 26% by weight of solid feed, respectively, and the solid feed rate was 10 kg/h or 21 $t/m^2$ per day. The same coke breeze was used as reductant, and the thickness of the coke layer was maintained at about 3-5 cm in the same manner as in Example 1. During the test the waste gas temperature was about 1500° C., the temperature above the receiving crucible was about 1510° C., and the temperature on the inside of the crucible bottom was about 1425° C.

After the run ended, pin samples of the liquid reduced metal were taken. The metal contained, in wt. %:

| Cu | Ni | Fe | S | O | C |
|---|---|---|---|---|---|
| 44.3 | 50.2 | 3.95 | 0.73 | 0.04 | 0.07 |

In this test, the consumption of coke was about 11% by weight of the oxide feed and the waste gases reduction potential was in the range of 0.01-0.05. It is evident that a substantial afterburning of CO rising from the coke layer took place in this experiment, thereby resulting in a much lower reduction potential of the waste gases as well as in some increase of the waste gas temperature (combustion zone) and the temperature just above the receiving crucible (reduction zone) as compared to corresponding values in Example 1.

COMPARATIVE TESTS

In contrast to the good results obtained in Examples 1 and 2, very poor results were obtained when flame reduction was attempted using fuel aeration ratios of about 65% and 55%. At 65% fuel aeration, a non-fluid product was obtained even though the surface temperature of the product was 1440°-1450° C. Dust and crucible products were recovered with the following analyses, in weight percent:

| | Ni | Cu | Co | Fe | O |
|---|---|---|---|---|---|
| Crucible Product | 45.9 | 42.0 | 0.59 | 2.36 | 9.51 |
| Dust | 9.07 | 76.8 | 0.13 | 8.70 | 4.32 |

XRD analysis indicated that the crucible product was mainly a mixture of a copper-nickel alloy and nickel oxide whereas the dust was a mixture of copper-nickel alloy, cuprous copper oxide and ferrite. The overall degree of reduction of the blended oxide feed was only 66%.

The second flame reduction experiment was then conducted at a fuel aeration ratio of about 55%. The required fuel consumption at this aeration was calculated to be 22% methane by weight of solid feed. The solid feed rate was 8.8 kg/h while all other essential parameters remained virtually the same as in the previous flame reduction experiment.

When this experiment was finished suction pin samples could not be obtained as the crucible contents were again not fluid. The crucible product sampled by drilling and the dust contained 5.0 and 4.5% oxygen respectively. The overall degree of reduction was 75%. XRD analysis indicated that, in addition to a copper-nickel alloy, the crucible product contained nickel oxide and the dust contained cuprous copper oxide and ferrite, that is, the phase composition of the final materials obtained in the second experiment was the same as in the first.

Thus, it was experimentally demonstrated that even at an aeration ratio as low as 55% the reduction of nickel and copper oxides could not be completed in the flame. Besides, at aeration ratios of 65% and 55%, the fuel consumption required to maintain the adequate process temperature are, respectively, 2.3 and 3.7 times larger than the fuel consumption at 100% aeration ratio. It could be said that, perhaps, with much finer particle size of the oxides and at aeration ratio, let us say, 45%, a much better degree of flame reduction could be achieved as the reduction potential at this aeration would be almost twice as high in comparison with that at the 55% aeration (FIG. 1). But fuel consumption then would have to be about 9 times the fuel consumption at 100% aeration ratio, that is, about 56% by weight of the oxide feed used in the above example. In addition, an enormous volume of waste gases per unit weight of solid feed would be produced resulting in a very high rate of dusting. Finally, the exhaust gases would retain a predominant proportion of the chemical energy of the fuel unutilized, and this would necessitate employing a system for afterburning and waste gas heat recuperation. In this case, flame reduction smelting process would become even more economically unattractive for production of non-ferrous metals.

Another embodiment of the present invention consists of the application of a reduction smelting process to a material containing non-ferrous base metals and iron - all predominantly in oxidic form. The main objective of a process of this kind is to reduce and recover the non-ferrous metals into a molten phase highly enriched in these metals while iron oxides are reduced selectively to the degree of reduction required to form a discardable molten iron-containing slag. One example of such material is copper calcine - a product of oxidation roasting of a sulfidic copper concentrate. In this case, crude copper and an iron silicate slag (or iron calcareous slag) are the final products of the process.

Those skilled in the art of extractive metallurgy are well aware of the dramatic difference between the thermodynamic conditions required for reduction of free copper oxide and the conditions required to reduce copper oxide from iron silicate slags in order to render the slags discardable. Free copper oxide is reduced to copper metal with $CO$-$CO_2$ or $H_2$-$H_2O$ mixtures containing very small concentrations of CO or $H_2$. For example, the gas phase in equilibrium with $Cu_2O$-Cu mixture at 1250° C. contains only about 0.005 vol. % of CO. On the other hand, to obtain a 25% $SiO_2$ iron silicate slag containing 2.5% Cu requires that the slag be equilibrated with a $CO$-$CO_2$ mixture containing about 9.5 vol. % of CO, which corresponds to a $CO/CO_2$ ratio of about 0.1. The same slag at the same temperature will contain 1% Cu at $CO/CO_2$ ratio of about 0.75, and a further increase in $CO/CO_2$ ratio up to about 2.0 will decrease the copper content of the slag down to about 0.6%.

The above relationship between the slag copper content and the gas phase reduction potential ($CO/CO_2$ ratio) is the key to a reduction smelting process that calls for direct production of copper metal simultaneously with production of a discardable slag in the same furnace. It is evident from the relationship shown in FIG. 1 and from the foregoing discussion of this relationship as applied to the prior art as well as from the experimental data presented in previous examples that the simultaneous production of crude copper and a discard slag is not economically and technically feasible in a process that contemplates simultaneous heating and reduction in the flame. In particular, it is not feasible at all to produce crude copper and discardable slag containing, for example, 0.6% Cu in a process similar to that contemplated in U.S. Pat. No. 4,421,552.

On the contrary, in the process of the present invention in which the heating and the reduction are separated both in time and in space, the objective of production of crude copper and a discardable slag in the same furnace is attained in a simple and economical way as both the heating and the reduction are carried out under conditions which are suited best for each of these two steps of the proposed process of the present invention. Specifically the heating is carried out in a substantially non-reducing high temperature flame, whereas the reduction is accomplished in a thin layer of granular coke. This is demonstrated in the following example.

EXAMPLE 3

A blend of copper calcine and siliceous flux was continuously injected with natural gas and oxygen in the same manner and furnace as in the previous examples. Compositions of these materials were as follows, in wt. %.

| | Cu | Ni | Fe | S | $SiO_2$ | $Al_2O_3$ | CaO | MgO |
|---|---|---|---|---|---|---|---|---|
| Calcine | 33.0 | 1.11 | 34.3 | 0.35 | 2.50 | 0.94 | 0.94 | 0.50 |
| Flux | — | — | 0.07 | — | 99.2 | 0.43 | 0.01 | 0.01 |

Flux addition was 15% by wt. of calcine.

This run was conducted at a fuel aeration ratio of 100%. Accordingly, natural gas and oxygen inputs were set at 6.2% and 23.2% by weight of the blended solid feed. The solid feed rate was 9.9 kg/h or 21 t/m$^2$ per day. The same coke breeze was used and it was charged to the furnace in the same manner as described in Example 1 and 2. No special flux was used to slag the ash of the coke.

During the run the waste gas temperature was 1430°-1440° C., the temperature above the receiving crucible was 1440°-1450° C. and the temperature on the inside of the crucible bottom was about 1200° C.

After 1.5 hours of feeding, the run was discontinued and samples of the molten products were taken. They analyzed, in wt. %:

| | Cu | Ni | Fe | S | $SiO_2$ | $Al_2O_3$ | MgO | $Fe_3O_4$ |
|---|---|---|---|---|---|---|---|---|
| Crude Copper | 95.7 | 2.67 | 0.82 | 0.22 | — | — | — | — |
| Discard Slag | 0.47 | 0.03 | 49.3 | 0.06 | 28.0 | 2.65 | 3.81 | 6.2 |

A number of other runs were conducted under similar conditions using various granular carbonaceous materials such as petroleum coke, coal, anthracite coal, and varying the proportion of siliceous flux, as well as using a calcareous flux. As well, copper calcine with up to 1.9 wt. % S was used. Remarkably consistent results were obtained in all these runs with a discard slag copper content in the range of 0.4–0.9%. The consumption of the carbonaceous materials (including the coke breeze) was in the range of 5.6–8.0% by weight of the calcine and the waste gases reduction potential was in the range of 0.07–0.22. The latter values are many times lower than the equilibrium $CO/CO_2$ ratio of about 2 which is required to decrease the slag copper content down to about 0.6%. This fact confirms that in the process of the present invention the conditions in the reduction zone (thin layer of coke) and the furnace freeboard (combustion zone) differ very substantially and favorably so that the reduction and the combustion can proceed in the most efficient ways.

The following example illustrates the application of the present invention for reduction smelting of nickel calcine, an iron-containing product of partial oxidation roasting of sulfidic nickel concentrate. As opposed to copper calcine, nickel calcine contains significant quantities of sulfur, usually, in the range of about 5 to 12 wt. %. Most of this sulfur is sulfidic, but some quantities of sulfate sulfur may also be present in the calcine. A predominant proportion of the calcine iron is in the form of hematite and magnetite-trevorite solid solution, whereas a substantial proportion of the nickel still remains bonded with the sulfidic sulfur. The main objective of a reduction smelting process applied to nickel calcine is to reduce and concentrate nickel and other non-ferrous metals such as copper and especially cobalt in a matte, and to reduce iron oxides to wustite as required to produce a discardable iron silicate slag. This objective is best achieved by producing a sulfidic-metallic alloy containing nickel, copper and iron (a sulfur deficient matte) as was recommended in the USSR Author's Certificate No. 383753 and U.S. Pat. No. 4,344,792.

EXAMPLE 4

A blend of nickel calcine and siliceous flux was continuously smelted with natural gas and oxygen using the same equipment and procedure as described in the foregoing examples. The calcine was of the following composition, in wt. %:

| Cu | Ni | Co | Fe | $S_{total}$ | $SO_4^{2-}$ | $SiO_2$ | $Al_2O_3$ | CaO | MgO |
|---|---|---|---|---|---|---|---|---|---|
| 3.10 | 15.8 | 0.51 | 40.6 | 12.2 | 1.16 | 6.0 | 1.5 | 0.97 | 0.99 |

About 75% of the calcine iron was in the trivalent state of oxidation. The flux composition was the same as that given in Example 3, and the addition of it was 10.5% by weight of the calcine. To preserve the calcine sulfur from oxidation, the test was conducted at a fuel aeration ratio of about 98% using natural gas and oxygen inputs at 9% and 33%, respectively, by weight of the calcine. The solid feed rate was 8.9 kg/h or 19 t/m$^2$ per day. The same solid reductant was used as in the previous examples, and its layer was maintained 2–3 cm. thick.

During the run the waste gas temperature was about 1360° C., the temperature above the receiving crucible was about 1375° C. and the temperature on the inside of the crucible bottom was about 1200° C.

After 1.5 hours of feeding, the run was discontinued and samples of the molten matte and slag were taken. They analyzed, in wt. %:

| | Cu | Ni | Co | Fe | S | $SiO_2$ | $Al_2O_3$ | MgO | $Fe_3O_4$ |
|---|---|---|---|---|---|---|---|---|---|
| matte | 7.77 | 42.1 | 1.0 | 25.3 | 22.9 | — | — | — | — |
| slag | 0.17 | 0.19 | 0.10 | 45.0 | 1.47 | 28.7 | 3.78 | 3.65 | 6.5 |

These analyses indicate an excellent reduction, concentration and recovery of nonferrous metals in a sulfur deficient matte of very high grade (Cu+Ni+Co=51 wt. %). The consumption of the coke was only 2.4% by weight of solid feed and the waste gas reduction potential was only 0.19.

For the purpose of comparison, a test was carried out on the flame reduction smelting of nickel calcine according to the prior art. This test is described as follows.

COMPARATIVE TEST

The same blend of nickel calcine and siliceous flux as in Example 4 was melted with natural gas and oxygen using the same equipment as in previous examples but without the use of a coke layer. The test was conducted at a fuel aeration ratio of 62% using natural gas and oxygen inputs at 20% and 45% by weight of the calcine, respectively, and no solid reductant was used. The solid feed rate and the temperatures were similar to those indicated in Example 4.

After 1.5 hours of feeding, the run was discontinued and samples of the molten matte and slag were taken. They analyzed, in wt. %:

| | Cu | Ni | Co | Fe | S | $SiO_2$ | $Al_2O_3$ | MgO | $Fe_3O_4$ |
|---|---|---|---|---|---|---|---|---|---|
| matte | 9.65 | 42.5 | 1.1 | 22.9 | 22.4 | — | — | — | — |
| slag | 0.25 | 0.4 | 0.2 | 47.7 | 1.35 | 27.0 | 4.0 | 3.31 | 9.9 |

In this test, the fuel and oxygen inputs were 2.2 and 1.4 times higher than those in Example 4. Accordingly, the waste gas reduction potential was 0.77, that is 4 times greater than that in Example 4. Nevertheless, the reduction and recovery of nonferrous metals were significantly poorer as the slag nickel and cobalt contents were 2 times greater than those in Example 4.

The present invention has been so far demonstrated in this application with respect to materials containing nonferrous base metals in the chemical form of oxides (blend of copper and nickel oxides, copper calcine) or oxides plus sulfides (nickel calcine), with iron, when present, being predominantly in the oxidic form (copper and nickel calcines). The reduction smelting of these types of materials can be carried out only with the use of external fuel.

On the opposite side of the scope of this invention the reduction smelting process is applied to finely divided sulfidic materials such as sulfidic ores, concentrates, mattes etc., which can be smelted with oxygen autogeneously, that is, without the use of external fuel at all. With these materials, the formation of metal oxides to be reduced in a thin layer of granular coke in the reduction zone, occurs as a result of oxidation (combustion) of the sulfidic materials with oxygen. The highly exothermic oxidation of sulfides in the combustion zone generates practically all the heat that is required for the entire smelting process. Some additional heat may be generated, when necessary, through afterburning of carbon monoxide rising from the reduction zone. The concept of fuel aeration ratio is no longer convenient to use for combustion of sulfides since it is the metallurgically desired degree of desulfurization to be achieved as well as the efficiency of utilization of oxygen that will determine the weight proportion of oxygen to be used relative to the weight of sulfidic materials of a given mineralogy.

Those skilled in the art of extractive metallurgy will recognize that the desired degree of desulfurization will depend on the nature of sulfidic materials to be smelted and the requirements to the compositions of the final reduced products. In particular, with copper sulfidic concentrates, mattes and white metal ($Cu_2S$) it is metallurgically possible and desirable to oxidize and eliminate in the form of $SO_2$ practically all of the sulfur of the materials so that the only copper product to be obtained thereafter in the reduction zone will be copper metal. A high degree of desulfurization is also metallurgically possible and desirable, according to the present invention, in the case of processing sulfidic nickel concentrate resulting from separation of copper-nickel converter matte by slow-cooling and flotation technique as well as nickel or nickel-cobalt sulfidic concentrates that are precipitated from aqueous solutions of salts.

On the other hand, in the case of nickel sulfidic concentrate containing substantial quantities of iron it is desirable to produce a matte and reject as much of the iron as possible. Therefore, the proportion of sulfidic sulfur to be oxidized and eliminated will be governed by the desired grade of the matte and by the desirable matte sulfur content. The grade and the sulfur content of the matte are among the most important parameters affecting the losses of nonferrous metals, especially, cobalt, with the discard slags to be produced in the reduction zone, as well as the matte liquidus temperatures. In addition, there may be a variety of metallurgical situations associated with processing complex polymetallic sulfidic materials or blends of monometallic materials containing copper and nickel, or copper and lead, or copper, lead and zinc, etc., where either complete or partial desulfurization may be required depending on the objectives of the autogenous process. For example, a copper-nickel alloy may be desired as the only nonferrous metal product of the reduction smelting.

The efficiency of utilization of oxygen (or the oxygen efficiency) is the ratio of quantity of oxygen that is stoichiometrically required for achieving the desired degree of desulfurization to the quantity that is to be used in practice to obtain this desulfurization. Usually, oxygen efficiency is quite close to a 100% when a matte of a relatively low grade is produced, that is, when desired desulfurization is well below a 100%. In this case, the combustion gases consist almost exclusively of $SO_2$ and do not contain appreciable concentrations of free oxygen. As the desired degree of desulfurization approaches a 100%, oxygen efficiency may be expected to be less than a 100%, and, therefore, the combustion gases may contain some concentration of free oxygen.

It is evident then that the amount of heat generated in the combustion zone while combusting a given sulfidic material depends on the degree of desulfurization and, therefore, there exists a rigid interrelation between the heat generated and the desulfurization achieved. Besides, for a given degree of desulfurization, the amount of heat generated also depends on the nature of sulfidic materials being combusted and the nature of the metal-containing combustion products being produced.

When sulfidic materials substantially free of iron are dealt with, the combustion process is controlled in such a manner that the metal containing combustion products being produced in the flame are predominantly represented by the metals as exemplified by the following chemical equations:

$$Cu_2S + O_2 \rightarrow 2\ Cu + SO_2 \quad (1)$$

$$Ni_3S_2 + 2\ O_2 \rightarrow 3\ Ni + 2\ SO_2 \quad (2)$$

It was found, however, that the use of stoichiometric quantities of oxygen in accordance with these reactions does not necessarily result in obtaining the metals with adequately low sulfur content.

In order to obtain an adequately low sulfur content in the metals resulting from combustion of sulfidic materials with oxygen, it is preferred, according to the present invention, to use oxygen in the amounts slightly above the stoichiometric requirements such as those corresponding to the equations (1 and 2). In this case relatively small quantities of the metal oxides will be produced. Ideally, these quantities would be close to or slightly above those corresponding to the oxide (oxygen) solubility limits for a given metal. Under these circumstances, the metals resulting from combustion of sulfidic materials with oxygen will be either saturated or slightly supersaturated with oxygen and, therefore, they will contain little sulfur. In practice, however, it is difficult to control the process in such a way that the metal oxygen content will be precisely that corresponding to the oxygen saturation. Moreover, the oxygen saturation of the metals at the high combustion flame temperatures corresponds to a substantially higher oxygen content of the metals than at the lower temperatures in the reduction zone, and this will result in exsolution of oxygen from the metals in the form of metal oxides. Therefore, it is rather preferred to use such an excess of oxygen over the stoichiometric requirements of the reactions (1-2) that the metals produced in the flame are saturated with oxygen and a small proportion of them is obtained in the form of metal oxides. Moreover, in the combustion of sulfidic materials, oxide is always present in the material entering the furnace because it is an economic and environmental requirement that oxidic flue dusts be recycled to the furnace. The dissolved oxygen and the oxygen of the metal oxides is then eliminated in the reduction zone resulting in the final metals being at low contents of both sulfur and oxygen. This application of the present invention is especially advantageous when a significant amount of nickel is present in a copper sulfidic material as nickel tends to oxidize preferentially and produce a mush of nickel oxide.

When sulfidic materials containing non-ferrous base metals and iron are dealt with, the amount of heat that can be generated by combustion with oxygen to attain the metallurgically desired degree of desulfurization usually far exceeds the overall process heat balance requirements, and the excess of heat may become even greater due to afterburning of carbon monoxide contained in the gases rising from the reduction zone. Thus, the heat balance requirements are in conflict with the metallurgical objectives of producing final reduced products of the desired composition.

This problem of excess heat is simply and effectively solved by roasting a part of such sulfidic materials and blending low sulfur calcines thereby produced with the unroasted sulfidic materials to obtain a blended feed to be autogeneously smelted, as it was described earlier in U.S. Pat. No. 4,415,356. This proven technique provides for an adjustment of calorific power of the blended feed to any value required by the autogeneous heat balance and, therefore, renders any desulfurization achievable. The use of this technique within the scope of the present invention imparts some additional favorable qualities to the autogeneous process as it enhances the heat transfer from the combustion zone to the reduction zone and decreases the amount of reduction work to be done.

The enhancement of the heat transfer is primarily caused by the fact that the superheated condensed particles that are produced in the flame as a result of combustion of the sulfidic part of the blended feed as well as those of the blended calcines that are heated in the flame, are all molten with a rare exception of some very refractory oxidic compounds containing nickel and cobalt. All of these molten particles when superheated in the flame by about 200° C. to 400° C. over the required temperature of the final products, can carry all of the heat that is to be made available in the reduction zone and, therefore, the need in the heat transfer by the radiation is reduced to minimum. The decrease in the amount of reduction work to be done in the reduction zone, for example, in comparison with the case of reduction smelting of copper calcine (Example 3 above), occurs primarily due to two factors. One of them is the fact that a predominant proportion of copper in the sulfidic part of the blended feed will be, during combustion, transformed into copper metal back in the flame. The second factor originates from the fact that, under conditions of high temperature and oxygen partial pressure well below 0.1 atm. in the flame, iron oxides of a lower state of oxidation will be produced in the sulfidic part of the blended feed, whereas ferric iron and cupric copper oxides of the calcine part of the feed will partially dissociate as they are not thermodynamically stable under these conditions. As a result, there will be less oxygen entering the reduction zone with the superheated particles of the combustion process products and, therefore, there will be less reduction work to be done in the reduction zone in order to produce crude copper and a discard slag. Similar considerations are equally applicable to nickel, copper-nickel and other sulfidic materials.

As it was pointed out earlier, the convection of combustion gases to the reduction zone is not desirable as this would result in excessive gasification of the coke and would worsen the conditions of the reduction process. In the case of the autogeneous process of the present invention, this requirement of preventing combustion gases from penetrating into the reduction zone becomes even more important because penetration of the gases containing $SO_2$ will result not only in excessive gasification of the coke but also in back sulfidization of nonferrous metals as well as iron. Indeed, the conditions in the reduction zone are thermodynamically and kinetically very favorable for the back sulfidization to take place, with the $SO_2$ being the source of sulfur. This is illustrated by the following example.

EXAMPLE 5

Copper sulfidic concentrate and copper calcine that were used in this experiment had the following compositions, in wt. %:

| | Cu | Ni | Fe | $S_{total}$ | $SiO_2$ |
|---|---|---|---|---|---|
| Concentrate | 28.1 | 0.66 | 31.4 | 33.4 | 1.45 |
| Calcine | 34.3 | 1.14 | 35.0 | 0.45 | 2.70 |

The concentrate and calcine were blended together and with sileceous flux in weight proportions of 100:20:15, respectively, and the blend was continuously injected with oxygen into the same above adiabatic furnace as employed in the foregoing examples. The solid feed rate was 9.5 kg/h and the oxygen input was 46.7% by weight of the feed.

During the run the waste gas temperature was about 1420° C. and the temperature above the receiving crucible was about 1480° C.

An anthracite coal was charged into the receiving crucible in the amount of 11% by weight of copper feed (copper concentrate plus calcine). About 64% of this amount was consumed during the test, with the rest accumulated in the receiving crucible on the surface of the molten bath. Notwithstanding the presence of the reductant, the waste gas contained 5–7 vol. % of free oxygen, in addition to sulfur and carbon dioxides.

After the run had been discontinued, the following molten products were found in the crucible: metal, matte and slag. They analyzed, in wt. %:

| | Cu | Ni | Fe | S | $SiO_2$ | $Fe_3O_4$ |
|---|---|---|---|---|---|---|
| metal | 80.2 | 3.3 | 10.9 | 3.9 | — | — |
| matte | 51.5 | 1.7 | 23.0 | 20.5 | — | — |
| slag | 1.1 | 0.1 | 34.5 | 0.65 | 32.0 | 4.1 |

The copper composite material comprising the metal plus the matte contained, in wt.%: 62.0 Cu, 2.3 Ni. 18.6 Fe and 14.4 S. About 25% of the feed sulfur reported to this composite and, therefore, the degree of desulfurization was about 75%. However, under all the same conditions but without the use of reductant, only crude copper and a high copper-iron silicate slag saturated with magnetite were routinely produced in the same furnace, with the degree of desulfurization being close to a 100%.

Thus, it is evident that, in the above autogeneous smelting run with the use of reductant, about 25% of the input sulfur penetrated in the form of sulfur dioxide downwards from the combustion zone into the zone of reduction. This sulfur dioxide was reduced with carbon monoxide and carbon into elemental sulfur which, in turn, reacted with copper metal produced in the combustion zone. The net result of these side reactions is the formation of copper sulfide, i.e., back sulfidization. In addition, the presence of elemental and/or sulfidic sulfur in the coke layer enhanced the reduction and the back sulfidization of iron. As a result, instead of crude copper only, sulfur-saturated metal and matte as shown in the last previous table were produced.

On the other hand, Example 5 demonstrates clearly that even in the furnace used, which was not particularly adapted to carry out the autogeneous process of the present invention, an excellent reduction of iron oxides took place resulting in obtaining an iron silicate slag with a very low content of magnetite and copper in spite of the waste gas containing free oxygen. At the same time, the carbon consumption was substantially higher than that stoichiometrically required to produce the very well reduced slag of the above composition. All these facts indicate that about 25% of the volume of combustion gases penetrated into the reduction zone causing the back sulfidization and the excessive consumption (gasification) of the carbon.

In the autogeneous process of the present invention, a volume of reaction gases rising from the reduction zone is small. In the case with sulfide copper concentrate, for example, it is only about 10% of the volume of combustion gases, in contrast with about 30% and about 60% in the cases of reduction smelting of copper calcine and nonferrous metals oxides, respectively, utilizing external fuel. The relatively small volume of the reaction gases is an important cause of penetration of the sulfur-containing combustion gases into the reduction zone, but it is a combination of the relatively small volume of the reaction gases, a particular geometrical configuration of a furnace and trajectory of the feed jets (flames) that is to be dealt with in order to prevent the back sulfidization of nonferrous metals and iron, when present, as well as the excessive gasification of carbon.

This is achieved, according to the present invention, by providing a nonreducing and substantially sulfur-free zone intermediate between the reduction zone and the combustion zone. On the lower side, this intermediate zone gradually passes into the reduction zone, whereas on the upper side, it is adjacent to the combustion zone. The distribution of the reduction/oxidation potential of the furnace atmosphere with height of the furnace is thus realized.

Where the intermediate zone gradually passes into the reduction zone, the reduction potential gradually changes over from a value close to zero to a value approaching unity (FIG. 1). On the other hand, where the intermediate zone gradually passes into the combustion zone, practically no gaseous reductant is present. Instead, free oxygen may be available in the furnace atmosphere in addition to sulfur and carbon dioxides, as was the case in Example 5.

One or a combination of several practical means may be used to create the intermediate zone. For one thing, an oxygen containing gas such as air or oxygen enriched air, cold or preheated, may be injected into this intermediate zone in order to afterburn carbon monoxide rising from the reduction zone as well as to increase volume of the reaction gases, the latter being conducive to preventing the combustion gases from penetration into the reduction zone. Furthermore, a solid granular carbonaceous material designated to replenish the granular coke consumed for the reduction may be injected with the oxygen containing gas. In this case only a small part of the coarse carbonaceous material will have the time to burn off with the oxygen before falling out into the reduction zone. The overall quantity of the oxygen being injected into the intermediate zone should be at least equal to what is required for afterburning any carbon monoxide, whether rising from the reduction zone or resulting from partial burning off of the coarse carbonaceous material.

The above measures will be enhanced if the furnace geometry is somewhat extended vertically, thus providing better conditions for the distribution of the reduction/oxidation potential of the furnace atmosphere with the height of the furnace. In addition, auxiliary burners for injecting an oxygen containing gas into the intermediate zone are positioned slightly inclined upwards, by about 10°-15° from the horizontal, and the main burners such as those shown in FIG. 2 are positioned in such a way that the jet momentum becomes negligibly small before the jets reach the intermediate zone.

The present invention has been exemplified for two opposite extremes of the scope of its application, namely, for the case when all of the heat requirements of the process are satisfied with the use of external fuel and for the autogeneous process when external fuel is not required. There are a variety of technological situations in between these two extremes.

One example of the situation of this kind relates to a high grade copper concentrate containing a predominant proportion of the copper in the form of chalcocite ($Cu_2S$) and also containing a substantial proportion of refractory rock material which may include variable contents of silica, alumina, calcia, magnesia and iron oxides, etc. in various mineralogical forms. An objective of processing a concentrate of this kind is to produce crude copper and a discard slag. Usually, this will require an addition of a flux as it is a rare case that the rock material can be turned into a slag with acceptable physical properties without being properly fluxed. Under these circumstances, even complete desulfurization of the concentrate by combustion with oxygen may not be able to generate as much heat as required.

According to the present invention, there are two alternative ways of meeting the objective of producing crude copper and a discard slag from a concentrate with the above characteristics. One way is to blend this concentrate with another sulfidic material so that the blend can be smelted autogeneously as exemplified earlier. An alternative way is to supplement the heat generated through oxidation (combustion) of sulfides with the heat of combustion of a fuel added to the feed. In this latter case, the amount of oxygen relative to the fuel added is always much greater than that corresponding to the fuel aeration ratio of 100% and the excess oxygen is used to combust sulfides.

Another example of the situation when all the heat required cannot be generated only by combustion of metal sulfides relates to processing materials consisting of a mixture of finely divided non-ferrous metals in the elemental and sulfidic forms plus recycled dust, when only a partial desulfurization is desired. Such is the situation with an intermediate product of separation by slow cooling, milling, flotation and magnetic separation of copper-nickel converter matte. This intermediate product typically contains, in wt. %: 10-20 Cu, 55-65 Ni, 1-3 Co, 1-3 Fe, 14-18 S and substantial quantities of precious metals. Mineralogically, this material is mainly represented by nickel-copper alloy metallics and sulfides of copper and nickel. The metallurgical objective of processing this semiproduct is to transform it into a feed which is most suitable for carbonylation. The feed is most suited for carbonylation when it contains significantly less sulfur and is melted and then rapidly quenched by granulation. During carbonylation, most of the nickel of the feed is separated from the copper, cobalt, sulfur and precious metals. Currently, this feed is prepared in a top blown rotary converter in a number of successive steps such as melting, partial desulfurization (top blown oxidation), back reduction of nickel oxide being formed during desulfurization and, finally, granulation.

According to the present invention, the above intermediate product and an addition of fuel are injected through a burner with oxygen into a preheated combustion zone, the weight proportion of oxygen relative to the fuel being substantially greater than that corresponding to a 100% aeration with the excess oxygen being adjusted to be sufficient to provide for the desired degree of desulfurization. The combustion process in this case includes three main features:

(a) complete combustion of fuel, (b) partial desulfurization and (c) partial oxidation of nickel-copper alloy metallics.

The superheated condensed products of the combustion process are separated from the combustion gases and fall downwards into the reduction zone onto a thin layer of granular coke floating on the surface of the molten bath of the final product produced or premelted earlier. All of the phenomena taking place in the reduction zone have already been described earlier. The final molten product is then granulated. In this variation of the process of the present invention, a solid granular carbonaceous material is fed into the reduction zone separately, that is, not through the feed burner.

It was found in a number of experiments conducted with the semiproduct of the above composition that the degree of desulfurization can be easily controlled by the value of the excess of oxygen in the combustion gases. For example, when concentration of free oxygen in the combustion gases (after complete combustion of a required addition of fuel) was increased from 9 volume % to 35 volume %, the degree of desulfurization increased from 33% to 62%. It was also found that, when solid reductant was not used, it was not possible to obtain both the desired degree of desulfurization and homogeneous melt, as substantial quantities of a mush were produced. This mush typically contained, in wt. %: 7-16 Cu, 50-65 Ni, 1-3 Co, 3-10 Fe, 4-6 S and 8-15 oxygen.

An alternative way of preparing feed for carbonylation is to blend the above intermediate product with nickel oxide, readily available to a producer treating copper-nickel converter matte, and to smelt the blend in a way similar to reduction smelting of nickel calcine as it has been described in Example 4. If some desulfurization is still required, then the fuel aeration ratio can be adjusted accordingly.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A process for reduction smelting of finely dividely material containing at least one base metal from the group of copper, nickel and cobalt at least partly in oxidic form comprising:

(a) injecting said material along with fuel and oxygen and finely divided flux, if any, into a bounded space while combusting said fuel with at least an aeration ratio of about 90% to produce an essentially non-reducing high temperature flame;

(b) superheating in said essentially non-reducing flame finely divided particles containing said base metal to a temperature in excess of the highest melting point of reduced product to be produced;

(c) projecting said superheated particles essentially evenly onto as thin layer of particulate coke floating on the surface of a molten bath of said reduced products, said thin layer of coke and the adjacent atmosphere comprising a reduction zone;

(d) reducing oxides of said base metals in said reduction zone with the reduced products being obtained in the liquid state, while supplying all required heat to the reduction zone solely in the form of sensible heat of said superheated particles and by radiation from said non-reducing flame;

(e) percolating said reduced products through said coke layer to said molten bath;

(f) withdrawing said reduced products from said molten bath; and (g) supplying a solid, granular, carbonaceous material to said thin layer of granular coke to replenish coke consumed in the reduction.

2. A process as in claim 1 wherein said fuel is at least partially a finely divided sulfidic material and one of the reduced products is a metal or matte.

3. A process as in claim 2 wherein said sulfidic material contains base metal from the group of copper, nickel and cobalt.

4. A process as in claim 1 wherein the base metal in said finely divided material is essentially oxidic, carboniferous fuel is employed to provide said non-reducing flame having an aeration ratio close to 100% and the reduced product is essentially metallic.

5. A process as in claim 2 wherein base metal is present as a sulfidic specie and the reduced product is a matte or a metal.

6. A process as in claim 1 wherein said base metal is present as a sulfidic specie and the reduced product is a matte or a metal.

7. A process as in claim 1 wherein said finely divided material contains a significant amount of material to be fluxed, flux is heated in said flame and a molten, discardable slag layer exists between said thin bed of particulate coke and said molten reduced product.

8. A process as in claim 7 wherein said material to be fluxed is iron.

9. A process as in claim 8 wherein flux for said iron impurity is selected from siliceous fluxes and calcareous fluxes.

10. A process as in claim 1 wherein said fuel is a flowable substance selected from the group of hydrocarbon gases, hydrogen, hydrocarbon liquids, finely pulverized carbonaceous solid and elemental sulfur.

11. A process as in claim 1 wherein a finely divided matte is present in said finely divided material in addition to oxide.

12. A process as in claim 1 wherein particles of coke in a size range of about 5 to about 25 mm in cross-sectional dimension are fed into said bounded space to provide said thin layer of particulate coke.

13. A process as in claim 1 wherein finely divided material fuel, oxygen and flux are injected into said bounded space in which said flame is sustained through at least one burner.

14. A process as in claim 13 in which particulate coke in a size range of about 5 to about 25 mm in cross-sectional dimension is fed through said at least one burner.

15. A process as in claim 13 wherein said at least one burner is positioned to provide at least one flame extending generally horizontally across said bounded space whereby gaseous products and non-gaseous products of said at least one flame separate by gravity with non-gaseous products falling onto and through said thin layer of particulate coke located below said flame.

16. A process as in claim 2 wherein said flame and said layer of particulate coke are separated by a non-reducing, essentially sulfur-free gas therebetween.

17. A process as in claim 16 wherein sulfur dioxide is produced in said flame and is isolated from the coke of said bed by said gas between said flame and said layer.

* * * * *